US006612083B1

(12) United States Patent
Richards

(10) Patent No.: US 6,612,083 B1
(45) Date of Patent: Sep. 2, 2003

(54) SYSTEM OF BUILDING CONSTRUCTION

(76) Inventor: William J. Richards, P.O. Box 1277, Morgantown, WV (US) 26507

( * ) Notice: Subject to any disclaimer, the term of this patent is extended or adjusted under 35 U.S.C. 154(b) by 0 days.

(21) Appl. No.: 10/105,417

(22) Filed: Mar. 26, 2002

Related U.S. Application Data

(60) Provisional application No. 60/278,735, filed on Mar. 27, 2001.

(51) Int. Cl.[7] ..... E04C 1/00

(52) U.S. Cl. ..... 52/309.11; 52/309.12; 52/309.14; 52/309.17; 52/182; 52/127.12; 52/309.1

(58) Field of Search ..... 52/309.12, 309.14, 52/309.17, 309.11, 182, 127.12, 309.1; 425/426, 431, 439; 411/383, 392, 410; 249/215, 42

(56) References Cited

U.S. PATENT DOCUMENTS

| | | | | | |
|---|---|---|---|---|---|
| 2,732,606 | A | * | 1/1956 | Wheeler | 249/215 |
| 3,648,961 | A | * | 3/1972 | Farrow | 249/42 |
| 4,373,309 | A | * | 2/1983 | Lutz | 52/182 |
| 4,393,635 | A | * | 7/1983 | Long | 249/215 |
| 4,616,455 | A | | 10/1986 | Hewison | |
| 4,698,947 | A | | 10/1987 | McKay | |
| 4,762,453 | A | | 8/1988 | DeCaro | |
| 5,390,459 | A | * | 2/1995 | Mensen | 52/426 |
| 5,540,020 | A | * | 7/1996 | Santini | 52/309.12 |
| 5,771,648 | A | * | 6/1998 | Miller | 249/215 |
| 6,070,380 | A | | 6/2000 | Meilleur | |
| 6,113,060 | A | * | 9/2000 | Wilde | 249/215 |
| 6,240,692 | B1 | * | 6/2001 | Yost et al. | 52/309.11 |
| 6,276,104 | B1 | * | 8/2001 | Long, Sr. et al. | 52/309.11 |
| 6,406,239 | B1 | * | 6/2002 | Mauri | 411/383 |
| 6,418,686 | B1 | * | 7/2002 | Record | 52/309.14 |
| 6,481,178 | B2 | * | 11/2002 | Moore, Jr. | 52/309.12 |
| 2002/0026760 | A1 | | 3/2002 | Moore, Jr. | |
| 2002/0092251 | A1 | | 7/2002 | Alvaro et al. | |

OTHER PUBLICATIONS

Publication No: US 2001/0010140 A1 Aug. 2001 Ritter et al.*

Publication No: US 2002/0092251 A1 Jul. 2002 Alvaro et al.*

Publication No: US 2002/0026760 A1 Mar. 2002 Moore, Jr.*

* cited by examiner

*Primary Examiner*—Carl D. Friedman
*Assistant Examiner*—Nahid Amiri
(74) *Attorney, Agent, or Firm*—Krieg DeVault Lundy, LLP

(57) ABSTRACT

A system of building construction comprises prefabricated modules with wall sections having finished paneling on both faces, inner foam panels and spacers made from insulating foam, and a steel-reinforced concrete core. The modules come complete with outer and inner finished panels, as well as inner insulating foam so that no on-site mounting of the panels to the wall module is required. The foam panels and facing panels are attached together with a plurality of coilies or rigid spacers, held together with simple screws to create a complete wall system. Concrete is subsequently poured into the module cores to create a monolithic structure. The Inner-wall and outer wall is already in place and needs only to be decorated as desired. All elements stay in place and no forms or heavy external bracing are needed. Since the factory-built modules may be attached to each other on-site with simple hand tools with relatively unskilled labor, this system is well adapted for Do-it-yourself enthusiasts and small general contractors.

20 Claims, 4 Drawing Sheets

SYSTEM OF BUILDING CONSTRUCTION

This application claims the benefit of provisional application 60/278,735 filed Mar. 27, 2001.

BACKGROUND OF THE INVENTION

This invention relates to a system of building construction with modules consisting of factory-built, custom-assembled units, and more specifically to prefabricated concrete form-work modules that can be assembled together to construct walls, floors and ceilings with minimal on-site labor.

The use of concrete as a construction material offers several advantages over the use of conventional wood and masonry materials due to its higher strength and resistance against the natural elements. For example, concrete structures are more resilient against decay, insect attacks, earthquakes, extreme winds and water damage.

Concrete form-work modules have been utilized for casting concrete structures. In these construction systems, insulated, composite walls formed of a concrete core and covered with sheet material have been produced by using the sheets to form molds for casting the concrete. This is done by pouring concrete between a pair of parallel, spaced sheets, which provide a mold for the concrete. The sheets and the concrete form a composite wall when the concrete is cured.

In most instances relating to this type of construction, the form-work modules must be assembled or modified on the premises. This on-site effort often requires the use of special tools and skilled labor as well as extra time, resulting in additional cost in order to complete the construction project. Furthermore, the sheets used in these systems are often overlaid with finished decorative paneling that is not capable of repeated disassembling and reassembling to the form-work module.

U.S. Pat. No. 4,698,947 issuing to McKay on Oct. 13, 1987 discloses a concrete wall form tie system used for aligning and positioning sheet-forming panels, immobilizing the panels against movement due to hydrostatic pressures of the concrete, and serving to better resist and dissipate any undue heat applied to wall construction. The wall form tie system comprises a pair of foamed plastic sheets with concrete poured into the space between the foamed plastic sheets to make a composite wall. An exterior wall covering formed of gypsum board or other construction material may be applied to either or both of the exposed surfaces of the foamed plastic sheets.

U.S. Pat. No. 6,070,380 issuing to Meilleur on Jun. 6, 2000 discloses a concrete wall formwork module that can be assembled with other identical modules like a brick wall to form a mold into which concrete is poured. Once assembled and filled with concrete, the modules are left in place providing a concrete wall with panels on both sides of it. The concrete wall formwork module comprises a reinforcing structure preferably made of parallel grids connected by transverse tie-rods, a pair of opposite panels forming spaced apart longitudinal side-walls, concrete poured between the foam panels, and arms defining a bridge for providing stability between adjacent modules when assembled to form a wall.

U.S. Pat. No. 4,762,453 issuing to DeCaro on Aug. 9, 1988 discloses a helical coil fastener for securing insulation or other material to a roof deck.

U.S. Pat. No. 4,616,455 issuing to Hewison on Oct. 14, 1986 discloses fastening assemblies for fastening compressible insulation material onto a roof decking.

SUMMARY OF THE INVENTION

It is therefore an object of the invention to provide a system of building construction comprising prefabricated modules that can be assembled with other similar and compatible modules to construct reinforced concrete-steel walls, floors and ceilings.

It is also an object of the invention to provide a system of building construction comprising prefabricated modules requiring an absolute minimum of on-site labor for assembly.

It is also an object of the invention to provide a system of building construction comprising prefabricated modules with wall sections having finished paneling that may be repeatedly disassembled and reassembled without significant wear on the modules.

In the broader aspects of the invention, the system of building construction comprises prefabricated modules with wall sections having finished paneling on both faces, inner panels and separators made from insulating foam, such as expanded polystyrene (EPS), and a steel-reinforced concrete core. The modules come complete with the outer and inner finished panels as well as the inner insulating foam so that no on-site mounting of the panels and foam is required. Additionally, the modules require very little labor for assembly since they are attached to each other on-site with simple screws to create a complete wall system. Concrete is subsequently poured into the module cores to create a monolithic structure with a concrete floor or foundation. Inner-wall gypsum board, or any other wood or composition paneling, is already in place and needs only to be decorated as desired. Similarly, the external panels, which also may be of any type of wood or composition paneling, are ready for finishing. All elements stay in place and no forms or heavy external bracing need to be placed or removed.

Since the factory-built modules may be attached to each other on-site with simple hand tools with relatively unskilled labor, and since they require almost no on-site modifications or special tools, the system of the present invention is well adapted to the efforts of Do-it-yourself enthusiasts and small general contractors.

The modules are held together in a sandwich configuration by unique wire elements called "coilies". The outer and inner: finishing panels and the interior foam panels and foam spacers of the modules are held in place by the coilies before concrete is poured. Since the facing panels and inner foam panels are not bonded with adhesive, they may be removed, replaced or remounted at any time in the future. Small depressions, or bosses, in the foam panels allow concrete to flow around the coiled ends of the coilies, so that after the concrete cures, the coils become embedded in the concrete, while the coiled wire ends become threaded inserts for standard screws. Consequently, the panels may all be disassembled and reassembled many times, e.g. repair after fire or flood, or simply to redecorate after long use, without significant wear to the imbedded coilies or screws.

The coilie and its use are one of the most unique and novel aspects of the present invention since other foam/concrete wall systems require on-site drilling of holes in sheet metal or plastic pieces inserted in the foam blocks to attach wall panels. In these systems the sheet-metal screws used can be removed and replaced only once or twice before the hole threads are stripped. Even at best the withdrawal force for sheet-metal screws is low (perhaps 50 to 200 pounds) depending on whether they are screwed into metal or plastic. Furthermore, in other systems the screws are not embedded in concrete at all. Since in the present invention the coilies are embedded in the concrete wall, they permit almost unlimited removal and replacement of the screws without significant wear while maintaining a minimal removal force of over 1000 pounds.

In addition to the wall system described above, a related and compatible reinforced concrete floor/ceiling system is also a part of the modular array. The floor/ceiling modules also have pre-placed facing panels and foam-panel constructions with coilies which permit the creation of a reinforced concrete floor/ceiling which has integral cast reinforced beams and which is tied by reinforced concrete to the wall modules. All previously described features carry over into the ceiling/floor system.

The above-mentioned and other features and objects of the invention and the manner of attaining them will become more apparent and the invention itself will be better understood by reference to the following description of embodiments of the invention taken in conjunction with the accompanying drawings wherein:

DETAILED DESCRIPTION OF THE PREFERRED EMBODIMENT

Figure 1:
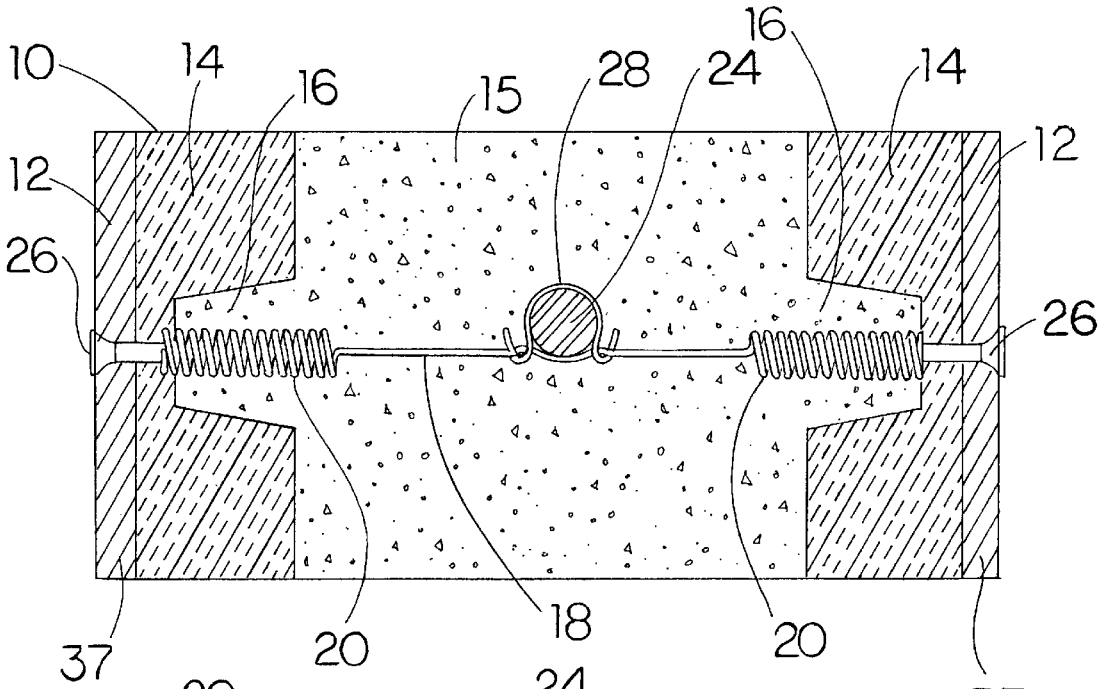
FIG. 1 is a cross sectional view of a portion of a wall module of the system of building construction according to a preferred embodiment of the present invention.
Figure 2:
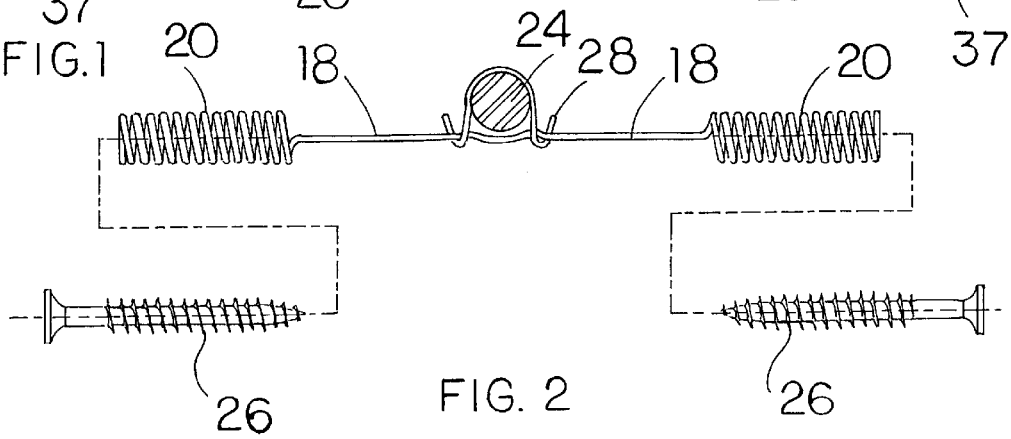
FIG. 2 is a side view of a coilie used to join opposing panels to the wall module.
Figure 3:
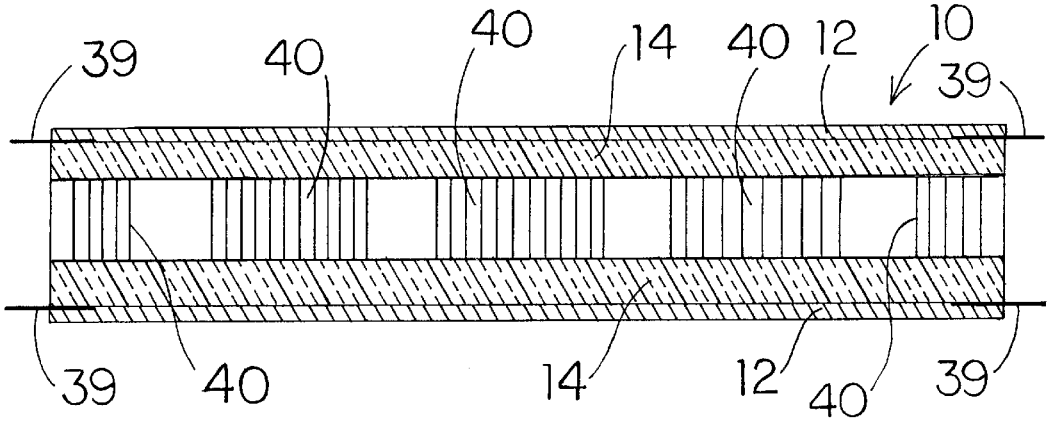
FIG. 3 is a cross sectional view of the modular panel showing metal joining strips and foam spacers.

Referring now to the drawings FIG. 1 through FIG. 3, wherein like reference numerals refer to like parts, there is shown a concrete form work wall module 10 with facing panels 12 at the end surfaces of the wall module. The facing panels 12 may be made of any wood or composite paneling, such as gypsum or wood, and are ready for finishing and decoration as desired. EPS foam panels 14 are placed inside the wall module adjacent to the inner faces of the facing panels.

The facing panels 12 and EPS foam panels 14 are held together in a sandwich configuration before concrete 15 is poured into the wall module 10 by a plurality of coilies 18, as shown in FIG. 1 and FIG. 2. Preferably, the concrete is poured insitu at the building site. Each coilie 18 has a steel wire element spanning horizontally across the width of the wall module 34. Coilies 18 are placed about each square foot of the panel area 12 (typically 4×8 feet in area) and may be made in any length to accommodate any desired thickness of concrete or EPS foam. Each coilie 18 has opposing coiled ends 20. An optional center loop 22 may be positioned between the coiled ends, which serves to provide a place to tie a tie wire 28 to a steel reinforcing bar 24 in the center of the concrete wall module 34. The coiled ends 20 of each coilie 18 are sized to threadably receive screws 26 which extend through the panels 12 to hold the panels 12 in place.

Alternately, each coilie 18 may be replaced with a rigid spacer 50, where solid concrete 15 is used between the facing panels 12. The rigid spacer 50 is preferably made of a molded plastic material. The rigid spacer 50 has screw flanges 52 located on each of the distal ends 54 of the rigid spacer 50. A center hole 56 is used to hold the reinforcing bar 24 in the center of the rigid spacer 50 with a tie wire 28. Spaced groves 60, 62 are located on each side of the center hole 56. The spaced groves 60, 62 are sized to receive a "C" washer 64 therein, to hold the foam panels 14 in place adjacent to the facing panels 12. See FIG. 6. The space between the spaced grooves 60, 62, determines the concrete 15 thickness within the wall module 10. The rigid spacers 50 are placed in the same positions as the coilies in the version with foam spacers 40.

Figure 5:
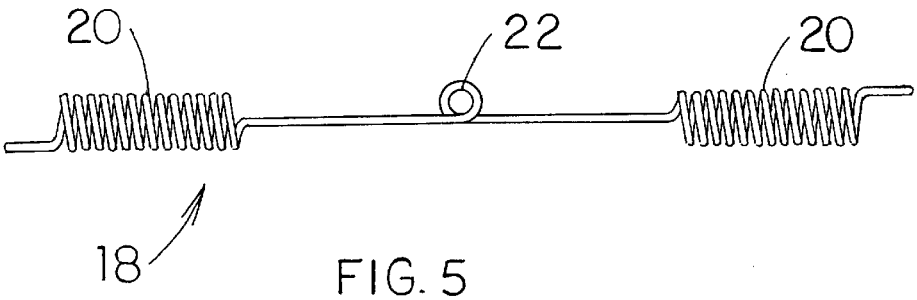
FIG. 5 is an alternate view of a coilie shown in FIG. 2, wherein an optional center loop is provided between the opposing coiled ends of the coilie.

The reinforcing bar 24 is held in place by being tied with tie wire 28 to the optional center loop 22 of the coilie 18, as shown in FIG. 5, or to detents 23 provided in the coilie 18, as shown in FIG. 2. Where no detents 23 are provided, the reinforcing bar 24 may be tied in the center of the coilie 18 with tie wire 28.

Coiled ends 20 are shaped to accept standard threaded screws 26, which secure the facing panels 12 to the wall module 10 and allow the plurality of coilies 18 to hold the facing panels and EPS foam panels 14 together in a sandwich configuration. Forming depressions located in the EPS foam panels 14 are called bosses 16. The bosses 16 allow concrete 15 to flow around the coiled ends 20 of the coilie 18 so that after the concrete cures, the coiled ends 20 become embedded in the concrete 15, with the coiled ends 20 forming threaded inserts for the screws 26.

Alternately, foam spacers 40 are arrayed between the foam panels 14 to provide additional insulation, while reducing the amount of concrete 15 required to fill the space between the foam panels 14. This also reduces the weight of the wall module 10. Rigid spacers 50 are used for underground construction, or where local building codes require solid concrete walls.

Concrete 15 is poured into the wall module 10 in situ, at the construction site, after the wall module 10 is positioned in place. The concrete 15 is then poured in between the facing EPS foam panels 12. The concrete 15 core of each module 10 takes the form of a concrete-steel lattice with steel reinforcing bars 24 laid in both vertical and horizontal directions in a uniform grid pattern. Normally the steel reinforcing bars 24 preferably form a grid pattern of about one-foot centers. Each coilie 18 forms a permanent anchor for tying the reinforcing bars 24 to respective coilies 18. Once the reinforcing bars 24 are embedded in concrete 15, the reinforcing bars 24 form rigid wall modules 10.

Open spaces between the EPS foam panels 14 may include foam spacers, as shown in FIG. 3. The use of additional foam spacers increases the R-factor of the wall and utilizes much less concrete than a similar wall of the same thickness, resulting in less weight per wall module 10. However, there is no significant loss of strength in the directions important to building integrity.

Figure 4:
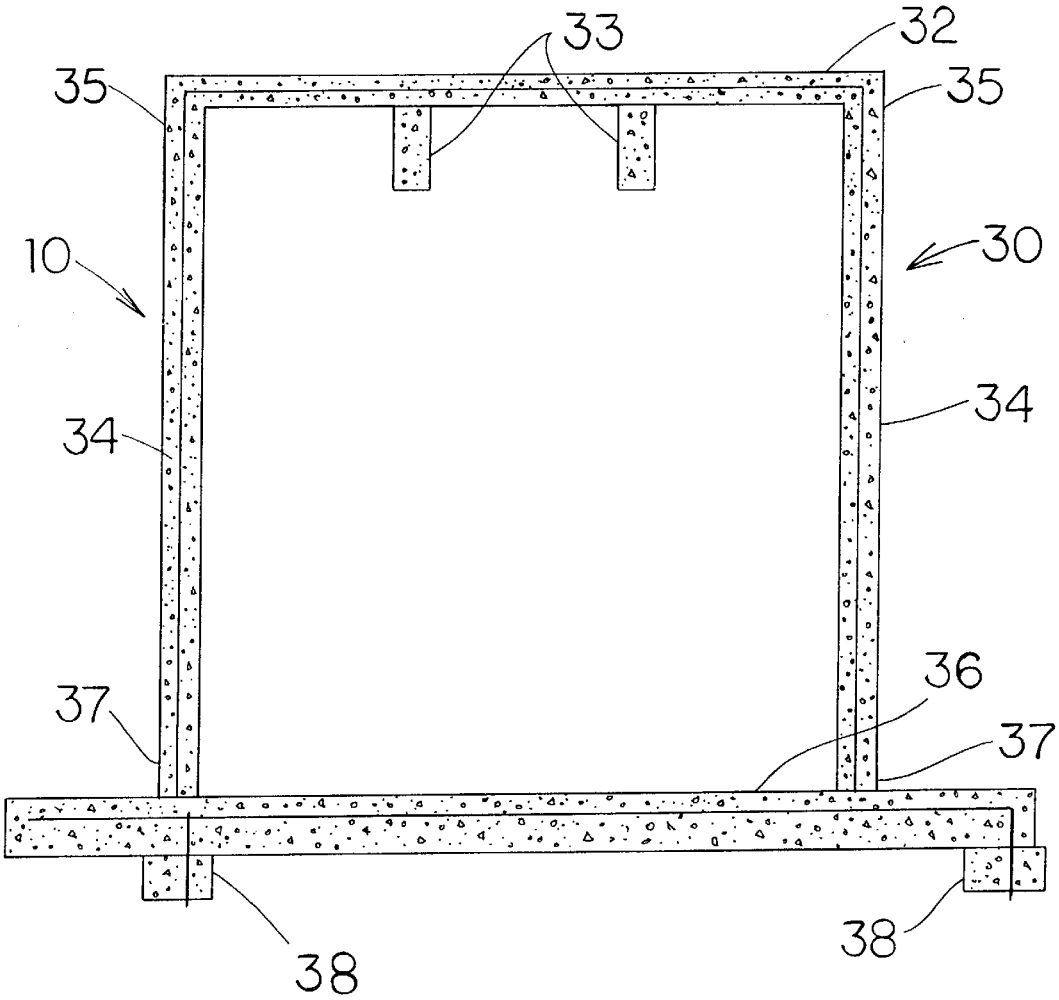
FIG. 4 is a cross sectional view of an assembled monolithic shell formed by two wall modules, a ceiling component and a floor slab supported upon a foundation.

FIG. 4 shows individual modules 10 which have been locked together into a monolithic shell 30 that comprises a ceiling component 32, with integrally cast beams 33 supported by the ceiling component 32. The ends of the ceiling components 32 are supported upon the upper ends 35 of vertical wall components 34. The lower ends 37 of the vertical wall components 34 are supported upon a horizontal floor slab 36. The horizontal floor slab 36 rests on a suitable foundation 38.

Figure 6:
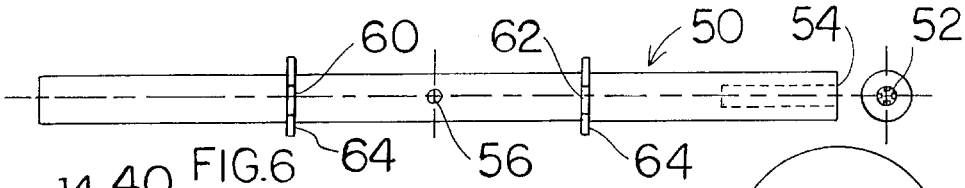
FIG. 6 is a side view of a spacer, used to replace the coilie for solid concrete, or underground use.

FIG. 5 shows an optional center loop 22 positioned in the center of a coilie 18. The optional center loop 22 provides an anchor for the tie wire 28 used to tie the reinforcing rod to the coilie 18. rigid spacers 50 may be used in place of coilies 18. Rigid spacers are shown in FIG. 6.

Figure 7:
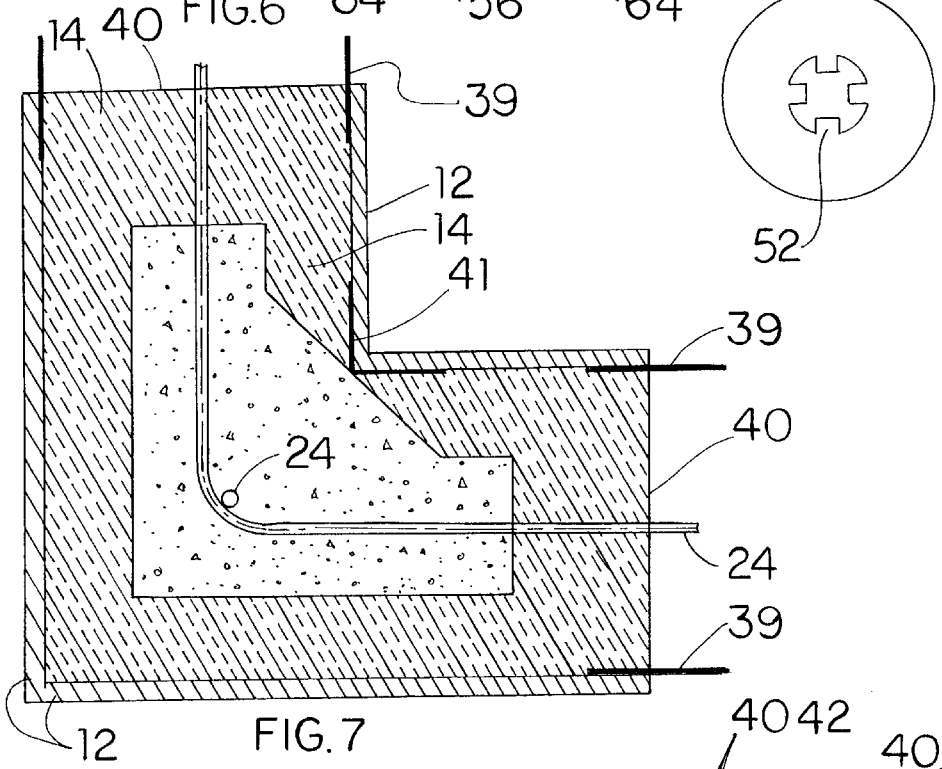
FIG. 7 is a cross sectional view of a corner module, showing metal tie strips used to join planar sections to the corner module.

Metal joining strips 39 are preferably secured to the wall module 10 between the facing panels 12 and the foam panels 14, as shown in FIG. 3.. The metal joining strips 39 are used to tie adjacent wall modules 10 together at assembly. Both straight metal joining strips 39 and right angle metal joining strips 41 are shown positioned for use, in FIG. 7.

Figure 8:
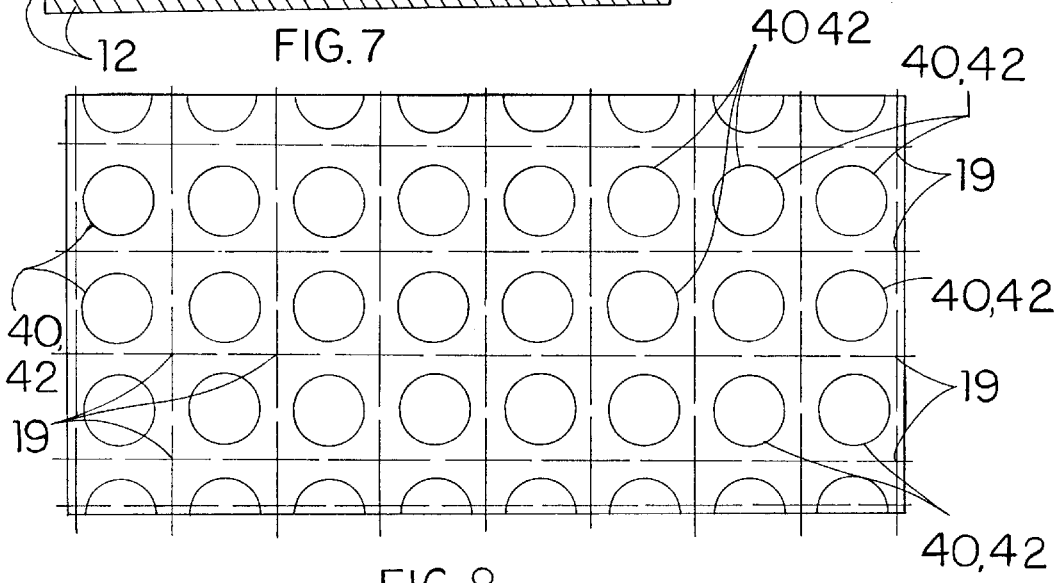
FIG. 8 is a side view of a four foot by eight foot panel showing standard hole locations, for location of foam or metal spacers.
Figure 9:
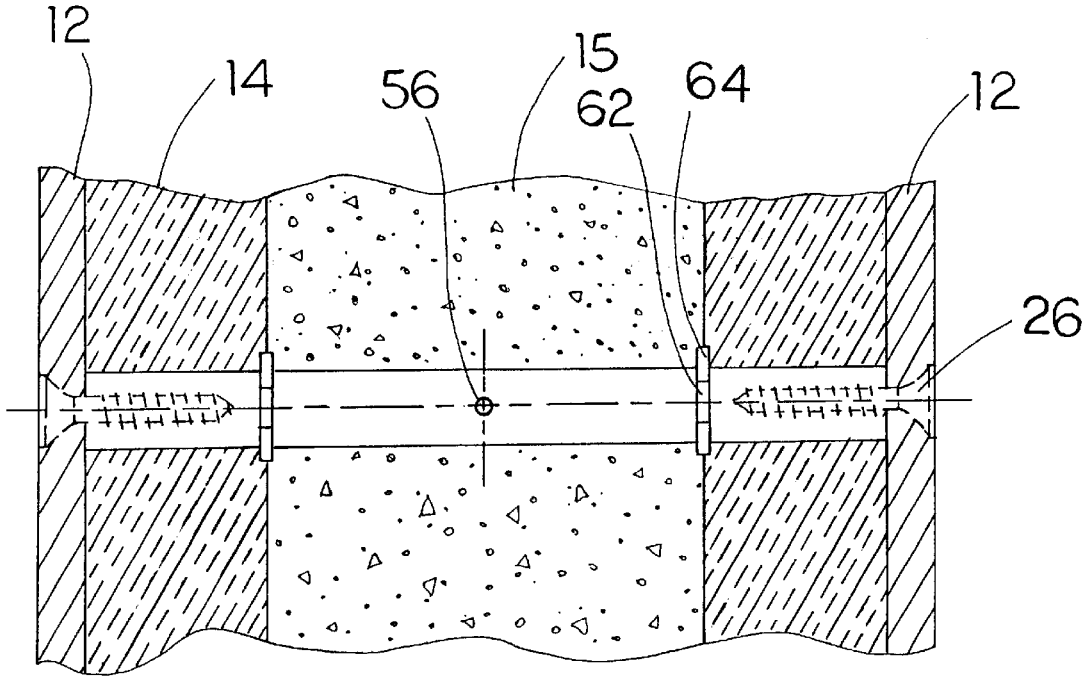

FIG. 8 is a top view of a four foot by eight foot panel showing the location of holes positioned therein. A grid of coilie holes 19 are placed among the foam spacers 40. Alternately, rigid spacers 50 may be used in place of the coilies 18.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

PARTS LIST

10 wall module
12 facing panels
14 EPS foam panels
15 concrete
16 bosses
18 coilie
19 coilie holes
20 opposing coiled ends
22 center loop (optional)
23 detents
24 reinforcing bar
26 screws
28 tie wire
30 monolithic shell
32 ceiling component
33 integrally cast beams
34 wall module
35 upper end
36 floor slab
37 lower end
38 foundation
39 metal joining strip
40 foam spacer
41 right angle joining strip
50 rigid spacer
52 screw holding flutes
54 distal end
56 center hole
60, 62 spaced groves
64 "C" washer

What is claimed is:

1. A system of building construction comprising prefabricated wall modules that can be assembled with other wall modules, each module comprising:

facing panels removably attached on opposing sides of a wall module, each facing panel having an inner face and an exterior face;

foam panels positioned adjacent to said facing panels within said wall module, with a plurality of bosses formed in each foam panel;

a plurality of coilies span horizontally in spaced relation across the width of the wall module, and each coilie positioned within one of the plurality of bosses of each foam panel, each coilie having coiled ends at opposing distal ends, each of the coiled ends sized and shaped so as to receive a threaded fastening means therein, the coilie and the fastening means holding the facing panels and foam panels in a sandwich type configuration;

a plurality of reinforcing bars positioned between the foam panels and tied to the coilie with a tie wire; and concrete poured insitu into the space provided between the foam panels, with the concrete penetrating into the bosses surrounding each coilie.

2. The system of building construction comprising prefabricated modules that can be assembled with other prefabricated modules as disclosed in claim 1, wherein each boss forms a depression that leads away from the concrete core and towards the inner face of each facing panel.

3. The system of building construction comprising prefabricated modules that can be assembled with other prefabricated modules as disclosed in claim 1, wherein a plurality of foam spacers are provided in spaced relation to each other, the foam spacers positioned between the foam panels located adjacent to said facing panels to reduce the amount of concrete required to fill the space between the foam panels.

4. The system of building construction comprising prefabricated modules that can be assembled with other prefabricated modules as disclosed in claim 1, wherein the coilie and reinforcing bar are made of steel.

5. The system of building construction comprising prefabricated modules that can be assembled with other prefabricated modules as disclosed in claim 1, wherein the facing panels are selectively disassembled and reassembled on site for ease of finishing, painting, or decoration.

6. The system of building construction comprising prefabricated modules that can be assembled with other prefabricated modules as disclosed in claim 1, wherein the foam panels are fabricated of extended polystyrene.

7. The system of building construction comprising prefabricated modules that can be assembled with other prefabricated modules as disclosed in claim 1, wherein each of the plurality of coilies is replaced with a rigid spacer.

8. The system of building construction comprising prefabricated modules that can be assembled with other prefabricated modules as disclosed in claim 7, wherein the rigid spacer has a transverse central hole for receiving a tie wire therethrough, the tie wire sized to bind a reinforcing bar to the rigid spacer, and the rigid spacer further has two spaced grooves, each spaced groove sized to receive a C-washer therein, the spaced grooves spaced apart to determine the concrete thickness within the prefabricated module, and the C-washers used to space the foam panels within the prefabricated modules.

9. The system of building construction comprising prefabricated modules that can be assembled with other prefabricated modules as disclosed in claim 1, wherein metal joining strips are used to join adjacent prefabricated modules at assembly.

10. The system of building construction comprising prefabricated modules that can be assembled with other prefabricated modules as disclosed in claim 1, wherein the metal joining strips are selected to be one of straight metal joining strips and angled metal joining strips.

11. A system of building construction comprising prefabricated modules that can be assembled with other prefabricated modules, each prefabricated module comprising:

facing panels removably attached at opposite sides of the prefabricated module, each facing panel having an inner face and an exterior face;

foam panels positioned inside the prefabricated module adjacent to the inner face of each of the facing panels;

a plurality of bosses formed in each foam panel, each boss forms a depression that leads away from a concrete core and towards the inner face of each facing panel;

a plurality of foam spacers provided in spaced relation to each other, the foam spacers positioned between the foam panels to reduce the amount of concrete required to fill the space between the foam panels;

a plurality of coilies positioned horizontally within the width of the module and extending between said facing panels, each coilie having coiled ends at each end and a center loop at its midpoint, each of the coiled ends being shaped to receive a threaded fastener therein;

the threaded fasteners inserted through each facing panel and into the coiled end of each coilie, the coilie and threaded fasteners holding the facing panels and foam panels together in a sandwich configuration;

a plurality of reinforcing bars, each reinforcing bar located in proximity to the center of the prefabricated module, the reinforcing bar tied with a wire to the center loop of said coilie; and a concrete core poured insitu into the space provided between the foam panels in the prefabricated modules.

12. A system of building construction comprising prefabricated modules that can be assembled with other prefabricated modules as disclosed in claim 11, wherein the facing panels are selectively disassembled and reassembled on site for ease of finishing, painting or decoration.

13. A system of building construction comprising prefabricated modules that can be assembled with other prefabricated modules as disclosed in claim 11, wherein the foam panels are made of extended polystyrene.

14. A system of building construction comprising prefabricated modules that can be assembled with other prefabricated modules as disclosed in claim 11, wherein the coilie and reinforcing bar are made of steel.

15. The system of building construction comprising prefabricated modules that can be assembled with other prefabricated modules as disclosed in claim 11, wherein each of the coilies is replaced with a rigid spacer.

16. The system of building construction comprising prefabricated modules that can be assembled with other prefabricated modules as disclosed in claim 11, wherein the rigid spacer has a central hole for receiving a wire therethrough, the wire sized to bind a reinforcing bar to the rigid spacer, and the rigid spacer further having spaced grooves each sized to receive a C-washer therein, the spaced grooves positioned on the rigid spacer to determine the concrete thickness within the prefabricated module.

17. The system of building construction comprising prefabricated modules that can be assembled with other prefabricated modules as disclosed in claim 11, wherein the rigid spacer is of a rigid plastic molded construction.

18. A system of building construction comprising prefabricated modules that can be assembled with other prefabricated modules, each prefabricated module comprising:

facing panels removably attached at opposite sides of the prefabricated module, each facing panel having an inner face and an exterior face;

foam panels positioned inside the prefabricated module adjacent to the inner face of each of the facing panels;

a plurality of bosses formed in each foam panel, each boss forms a depression that leads away from a concrete core and towards the inner face of each facing panel;

a plurality of rigid spacers having distal ends positioned horizontally within the width of the module and extending between said facing panels, each rigid spacer with a central hole for receiving a tie wire therethrough, the tie wire sized to secure a reinforcing bar to the rigid spacer, the rigid spacer further having spaced grooves, each groove sized to receive a C-washer therein, the spaced grooves positioned to determine the concrete thickness within the prefabricated module, the C-washer used to space the foam panels within the prefabricated module;

threaded fasteners inserted through each facing panel and into the distal ends of the rigid spacers to secure the facing panels and foam panels together in a sandwich configuration;

a plurality of reinforcing bars, each reinforcing bar located in proximity to the center of the prefabricated module, the reinforcing bar tied with a wire to the center loop of said coilie; and a concrete core poured insitu into the space provided between the foam panels in the prefabricated modules.

19. A system of building construction comprising prefabricated modules that can be assembled with other prefabricated modules as disclosed in claim 18, wherein the foam panels are made of extended polystyrene.

20. The system of building construction comprising prefabricated modules that can be assembled with other prefabricated modules as disclosed in claim 18, wherein the plurality of rigid spacers are replaced with a plurality of coilies positioned horizontally within the width of the module and extending between said facing panels, each coilie having coiled ends at each distal end, and each of the coiled ends being shaped to receive a threaded fastener therein.

* * * * *